United States Patent [19]

Turolla

[11] 3,994,471

[45] Nov. 30, 1976

[54] PLY JOINT BAR

[76] Inventor: Anthony Turolla, 340 E. 64th St., New York, N.Y. 10021

[22] Filed: Feb. 26, 1975

[21] Appl. No.: 553,291

[52] U.S. Cl. ..... 249/205; 249/193; 52/100; 52/461

[51] Int. Cl.[2] ..... G01J 1/32

[58] Field of Search ..... 52/98, 100, 469, 573, 52/699, 461; 404/47, 48, 65, 64; 249/194, 192, 205

[56] References Cited

UNITED STATES PATENTS

| | | | |
|---|---|---|---|
| 840,804 | 1/1907 | Prescott | 52/699 |
| 3,099,110 | 7/1963 | Spaight | 404/65 |
| 3,352,217 | 11/1967 | Peters | 404/65 |
| 3,411,260 | 11/1968 | Dill | 404/48 |
| 3,434,401 | 3/1969 | Kiewit | 404/65 |
| 3,512,318 | 5/1970 | Turner | 52/100 |
| 3,575,094 | 4/1971 | Hewitt | 404/65 |
| 3,667,177 | 6/1972 | Biela | 52/461 |
| 3,813,180 | 11/1972 | O'Brill | 404/48 |
| 3,822,858 | 7/1974 | Franklin | 249/174 |
| 3,871,787 | 3/1975 | Stegmeier | 404/48 |

FOREIGN PATENTS OR APPLICATIONS

| | | | |
|---|---|---|---|
| 442,678 | 1/1968 | Switzerland | 52/699 |

*Primary Examiner*—Price C. Faw, Jr.
*Assistant Examiner*—Henry Raduazo
*Attorney, Agent, or Firm*—Darby & Darby

[57] ABSTRACT

A ply joint bar for casting a seamless ceiling from a hardening material such as plaster or concrete, poured over the surfaces of adjacent molding panels, has a bridge with a lower surface resting on and flush with two such adjacent panels and an upper gable-like portion adapted to be anchored in the hardened casting material, an optional base member with two adjacent coplanar surfaces which grasp the underside of the panels, and a leg frangibly connected at one of its ends to the bridge and permanently connected at its other end to the base member, so as to separate adjacent panels sandwiched between the bridge and base member. After the casting material hardens, the molding panels are removed and the frangible leg separated from the bridge leaving a substantially seamless ceiling surface with the bridge embedded therein and its lower surface flush therewith.

14 Claims, 5 Drawing Figures

PLY JOINT BAR

BACKGROUND OF THE INVENTION

In the building construction field it is known to cast ceilings by pouring a suitable material, such as concrete or plaster, over a flat molding or supporting surface which is removed once the casting material has hardened. The supporting surface often comprises a number of panels of plywood, composition board, or other suitable material. Since the dimensions of ceilings commonly exceed the size of flat supporting panels which can be transported and handled conveniently, it is necessary that a plurality of such panels be employed to cast a ceiling of desirable size.

The supporting panels are generally arranged adjacent one another and held in place by suitable bracing members and the cast material is poured on top of them. When the material cast has hardened the ceiling may be lifted from the panels or the panels removed from beneath the ceiling leaving a unified sheet of casting material.

A serious drawback associated with this method of pouring ceilings results from the formation of a grid of seams on the ceiling's surface at the interface of adjacent supporting panels. The casting material, when in a fluid state, tends to occupy the crevices separating the panels and hardens leaving transverse projections which must be removed, if a flat surface is desired, by sanding, grinding or other machining. This operation is both costly and time-consuming. It is therefore desirable to provide an arrangement whereby ceilings may be cast by pouring the casting material over adjacent molding panels without leaving seams which must be smoothed before painting of the ceiling.

SUMMARY OF THE INVENTION

The present invention relates to a method and apparatus for the construction of ceiling which are poured over supporting panels which, after hardening, are ready for painting with little or no sanding or smoothing. More specifically, the invention comprises a frangible device having a connecting leg disposed between adjacent molding panels, an optional lower transverse cross piece supporting the panels, and an upper transverse bridge member with an upper gable-like anchoring portion about which the casting material is poured and a lower surface which rests on the molding or support panels, the bridge member being an integral part of the finished ceiling with its lower surface flush with the ceiling surface, and the connecting leg with lower transverse supporting cross pieces being detachable from the lower surface of the bridge member after the ceiling has hardened. The discontinuity left on the under surface of the bridge member is sufficiently inconsequential so that when covered with a decorative or protective coating material such as paint, a substantially smooth surface results over the entire ceiling.

It is therefore an object of the invention to provide a joint bar to support two adjacent molding panels over which a ceiling is to be poured.

Another object of the invention is to provide a joint bar having a member which is embedded in a poured ceiling along the area defined by the interfaces of molding or support panels over which the ceiling is poured and provides a smooth surface in the region of panel interface.

Still another object of the invention is to provide a joint bar wherein the members grasping the molding panels are detachably connected to the member which remains embedded in the poured ceiling.

A further object of the invention is to provide a joint bar with a surface lying flush with that of a ceiling in which it is embedded and suitable for adhesion by a coating material.

Still a further object of the invention is to provide a joint bar suitably shaped to be anchored in a ceiling poured over it.

Other and further objects will be apparent from the following description and drawings in which like reference numerals denote like parts.

DESCRIPTION OF THE PREFERRED EMBODIMENT

Figure 1:
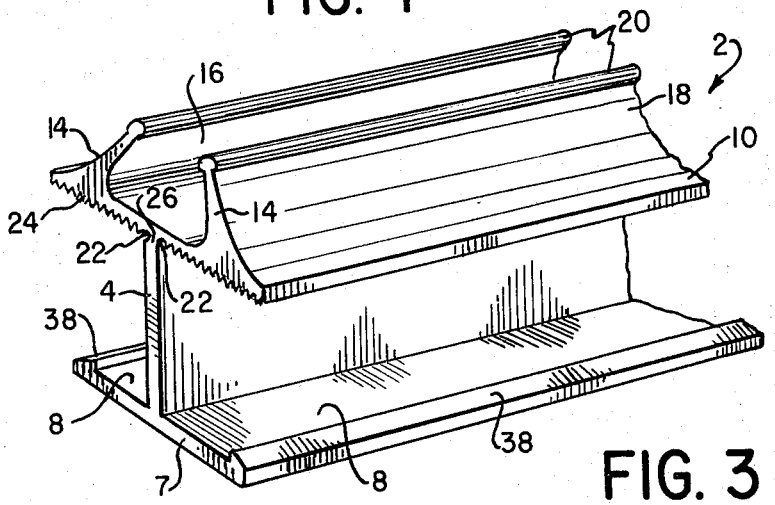
FIG. 1 is a perspective view of a segment of a preferred embodiment of the joint bar.
Figure 2:
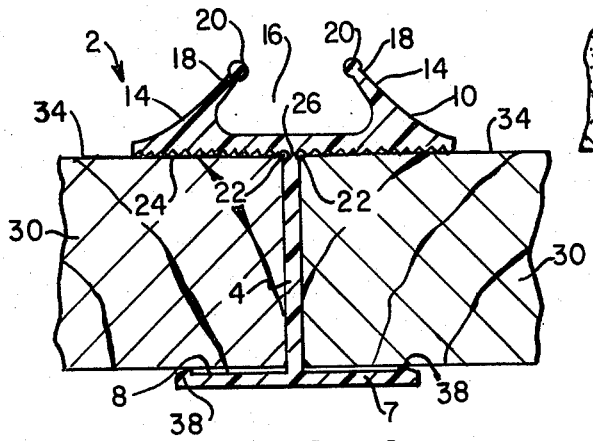
FIG. 2 is a transverse sectional view of the joint bar of FIG. 1 with molding panels inserted therein.
Figure 3:
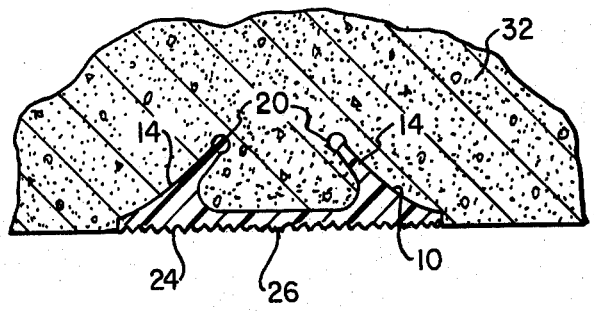
FIG. 3 is a transverse sectional view of a finished ceiling with bridge member of the joint bar embedded therein.

Referring now to the drawings, specifically FIGS. 1–3, a ply joint bar 2 is shown of a generally H shape which is made of either a substantially rigid or a semi-flexible material, for example, plastic or metal. The bar 2 is an elongated member, which is as long and/or as wide as the panels with which it is to be used and is uniform in shape throughout its length. The bar is preferably made by an extrusion process in long strips which are then cut to the appropriate size. Metal also can be used, for example extruded aluminum.

The H-shaped bar 2 includes a vertical detachable leg 4 to which is connected at the lower end thereof a transverse base 7 having supporting surfaces 8. Joint bridge member 10 is formed on the upper end of leg 4.

In the preferred embodiment of the invention, the joint bridge member 10 includes a generally gable-shaped piece having a lower, substantially flat but roughened surface 24 to which vertical leg 4 is attached, and two spaced walls 14 sloping upwardly and inwardly from section 24 and defining a channel 16 therebetween. The walls 14 are preferably curved and provided at edges 18 with lips 20.

The underside 24 of the bridge member 10 is roughened to facilitate mechanical bonding of paint or other covering material with which the ceiling is to be coated after completion of casting and separation of the frangible leg 4 and to reduce light reflection in applications where the ply joint bar is to remain exposed.

Supporting shoulders 38 are provided at the outer edges of support member surfaces 8 to reduce the contact area between the molding panels 30 and base 7 thereby facilitating insertion and removal of the molding panels 30. The shoulders 38 can be omitted when supporting panels capable of easy insertion are used.

To facilitate detachment of the frangible leg 4 and base 7 from the joint 10, grooves or incisions 22 are provided along the intersection of both surfaces of the leg 4 with the undersurface 24 of the bridge 10. This leaves a weakened portion 26 along the leg 4, where it meets the bride 10, which has substantially less resistance to strain caused by bending or tension forces applied to the support member 7 or leg 4 than any other point along the ply joint bar 2.

As the leg 4 is flexed about or pulled along the axis defined at 26, it will break away from the bridge 10 leaving a substantially smooth surface along the underside 24 of the bridge 10. The minor discontinuities in the surface left along the line of severance, i.e., between the grooves 22 are substantially eliminated when the ceiling is painted, the thickness of the paint material being sufficient to fill in the grooves 22 and recesses left therebetween and thus make invisible the joint between adjacent cast sections of the ceiling.

The following describes a method of forming a ceiling in place utilizing the ply joint bar. It is not necessary that the ceiling be formed in place but this has been found to be a convenient way of constructing building interiors. Furthermore, use of the ply joint bar is not restricted to the formation of ceilings but has application wherever it is desired to cast a continuous surface by pouring a hardening material over a plurality of molding panels.

Referring to FIGS. 2 and 3, two supporting panels 30 are positioned in adjacent spaced relationship with a ply joint bar 2 disposed therebetween. The panels are held between the undersides 24 of the bridge 10 and surfaces 8 of the base 7 either by insertion of the panels 30 in the ply joint bar 2 or by sliding the ply joint bar 2 into a space approximately equal to the thickness of the leg between adjacent panels 30 situated in coplanar relationship. For casting ceilings in place, the supporting panels 30 may be held by scaffolding or any other suitable temporary support. The supporting panels are preferably made of a strong, flat surfaced and inexpensive material such as plywood. However, any other material with similar properties may be used.

Once the supporting panels 30 and ply joint bar 2 are properly positioned, a casting material 32 is poured over the upper surfaces 34 of the support panels 30. Typical casting materials include concrete and plaster. However, any casting material which may be poured and then hardened may be used to form ceilings with the ply joint bar.

The casting material 32 is poured over the upper surfaces 34 of the supporting panels 30 and bridge 10 of the ply joint bar 2. The casting material 32 surrounds the gable-like anchor portion of the bridge 10 and occupies the channel 16. The inward slope of the walls 14 helps anchor the bridge to the casting material as do the rounded lips 20.

After the casting material 32 has hardened, the supporting panels 30 are either removed alone leaving a flat surfaced ceiling from which protrude the leg 4 and transverse base 7 which are subsequently severed from the bridge member or the connecting member 4 is pulled away from the cast ceiling together with the supporting panels at which time it is severed from the underside 24 of the bridge 10 leaving the ceiling structure shown in FIG. 3. The ceiling is then painted causing the minor discontinuities left along the line of severance at 26 to be covered and eliminated. The result is a contiguous ceiling showing no visible discontinuities between adjacent cast sections.

Figure 4:
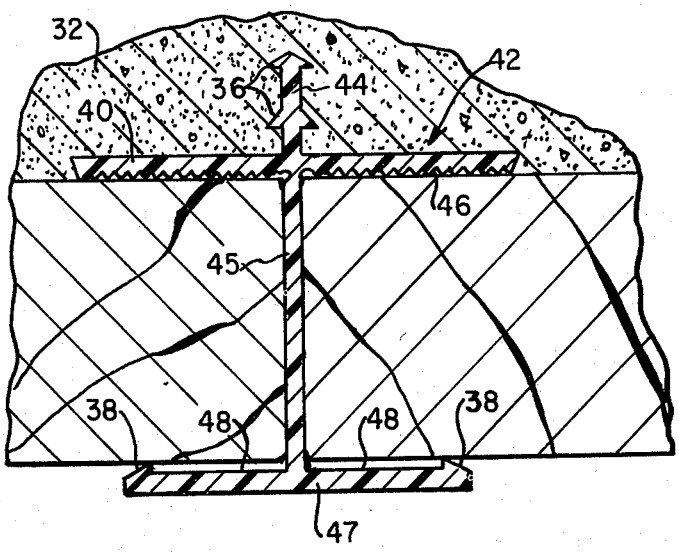
FIG. 4 is a transverse sectional view of a second embodiment of the joint bar with molding panels inserted therein.

A second embodiment of an H-shaped ply joint bar 42 is shown in FIG. 4. The bridge 40 of the ply joint bar 42 includes an upright wall 44 with barb-like shoulders 36 protruding therefrom at either side. The barb-like shoulders 36 help to anchor the bridge 40 in the cast material 32 when it hardens.

Figure 5:
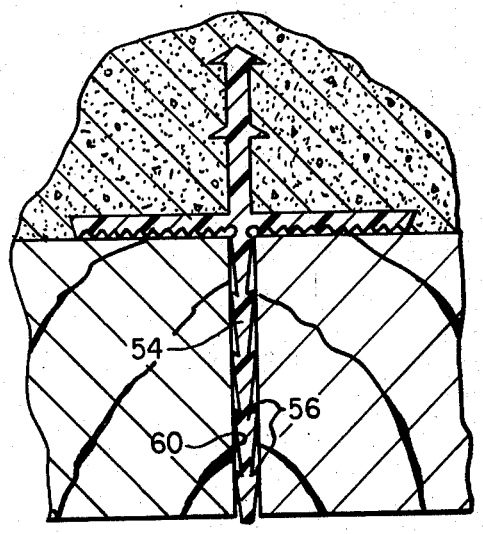
FIG. 5 is a transverse sectional view of a third embodiment of the joint bar with molding panels inserted therein.

A third embodiment of a T-shaped ply joint bar is shown in FIG. 5. This joint bar is adapted to be wedged between two adjacent supporting panels by insertion in a direction normal to the panel surfaces. To permit such insertion, there is no base, and the leg 54 is tapered as shown in FIG. 5. To prevent the joint bar, which lacks a base to grasp the underside of the support panels, from working loose, the leg 54 is provided in the barbs 56 which grasp the panel edge surfaces 60.

It is to be noted that modifications to and variations from the structural embodiments and method disclosed herein may be made without departing from the essence and spirit of the invention.

What is claimed is:

1. A joint bar for preventing formation of a seam in cast material in the area between the edges of two panels having planar surfaces on which the material is to be cast comprising:

a bridge member having an upper surface with anchor means projecting from said upper surface adapted for affixing said bridge member in the casting material poured thereover and hardened, and a substantially flat lower surface adapted to engage the upper surfaces of the panels so that said lower surface is substantially contiguous with the panel surfaces and a leg member attached to said lower surface, the edges of the panels being located adjacent said leg member, said leg member being frangible adjacent the lower surface to be broken away when the panels are removed so that said lower surface of said bridge member remains substantially smooth when said leg member is broken therefrom.

2. A joint bar according to claim 1 further comprising:

a base member with two adjacent coplanar surfaces, parallel to said lower surface and separated at adjacent parallel edges only by the thickness of said leg member, upon which the edges of two adjacent molding panels may be rested, said leg member permanently attached to said base member to form with it and said bridge member opposite open channels separated by said leg member and adapted to receive said adjacent molding panels.

3. A ply joint bar according to claim 2 wherein said surfaces of said base member further comprise shoulders to support said molding panels and raise them from said surfaces of said base member.

4. A ply joint bar according to claim 1 wherein said leg member is substantially transverse to said lower surface of said bridge member.

5. A ply joint bar according to claim 1 wherein said anchor means has two inwardly sloping walls.

6. A ply joint bar according to claim 5 wherein said walls terminate in a rounded lip.

7. A ply joint bar according to claim 1 wherein said anchor means includes a projecting member substantially transverse to said lower surface and having shoulder means protruding therefrom.

8. A ply joint bar according to claim 7 wherein said shoulder means has a barb-shaped cross-section.

9. A ply joint bar according to claim 1 wherein said lower surface is roughened to promote adhesion by coating materials.

10. A ply joint bar according to claim 1 wherein groove-like incisions are formed along the intersection of said leg member with said lower surface of said bridge member.

11. A ply joint bar according to claim 1 made from a rigid material selected from the group consisting of metal and plastic.

12. A ply joint bar according to claim 1 made from a flexible plastic material.

13. A ply joint bar according to claim 1 wherein said leg member is tapered.

14. A ply joint bar according to claim 13 wherein said leg member is barbed.

* * * * *